US006581801B2

(12) United States Patent
Gauthier

(10) Patent No.: US 6,581,801 B2
(45) Date of Patent: Jun. 24, 2003

(54) SINGLE SOAP PUMP FOR USE WITH WATER DISPLACEMENT SOAP CONTAINERS AND PERISTALTIC PUMP

(75) Inventor: Jerome M. Gauthier, Roselle, IL (US)

(73) Assignee: Sloan Valve Company, Franklin Park, IL (US)

( * ) Notice: Subject to any disclaimer, the term of this patent is extended or adjusted under 35 U.S.C. 154(b) by 101 days.

(21) Appl. No.: 09/893,844

(22) Filed: Jun. 28, 2001

(65) Prior Publication Data

US 2002/0113084 A1 Aug. 22, 2002

Related U.S. Application Data

(63) Continuation-in-part of application No. 09/834,447, filed on Apr. 13, 2001, and a continuation-in-part of application No. 09/788,093, filed on Feb. 20, 2001.

(51) Int. Cl.[7] ..... B67D 5/54

(52) U.S. Cl. ..... 222/57; 222/61; 222/63; 222/66; 222/95; 222/105; 222/136; 222/144.5; 222/395; 222/400.8

(58) Field of Search ..... 222/57, 61, 63, 222/66, 95, 105, 136, 144.5, 395, 400.8

(56) References Cited

U.S. PATENT DOCUMENTS

| | | | | |
|---|---|---|---|---|
| 4,722,372 A | | 2/1988 | Hoffman et al. | |
| 5,242,081 A | | 9/1993 | van der Heyden et al. | |
| 5,353,963 A | | 10/1994 | Gorski et al. | |
| 5,727,713 A | * | 3/1998 | Kateman et al. | 222/386.5 |
| 5,899,362 A | * | 5/1999 | Moran | 222/95 |
| 6,016,935 A | | 1/2000 | Huegerich et al. | |
| 6,168,048 B1 | * | 1/2001 | Xu et al. | 222/386.5 |

* cited by examiner

*Primary Examiner*—Kenneth Bomberg
(74) *Attorney, Agent, or Firm*—Cook, Alex, McFarron, Manzo, Cummings & Mehler, Ltd.

(57) ABSTRACT

A soap dispensing system includes a soap dispensing fixture and first and second sources of soap connected to the fixture. Each of the sources of soap includes a closed container and a collapsible soap container positioned within the closed container. Each of the collapsible soap containers is connected to the fixture. There is a source of fluid pressure and control elements connected between the source of fluid pressure and each of the first and second closed containers. The application of pressure, from the source, as controlled by the control elements, will apply fluid pressure to either the first or second collapsible soap container to cause it to dispense soap to the soap dispensing fixture.

12 Claims, 1 Drawing Sheet

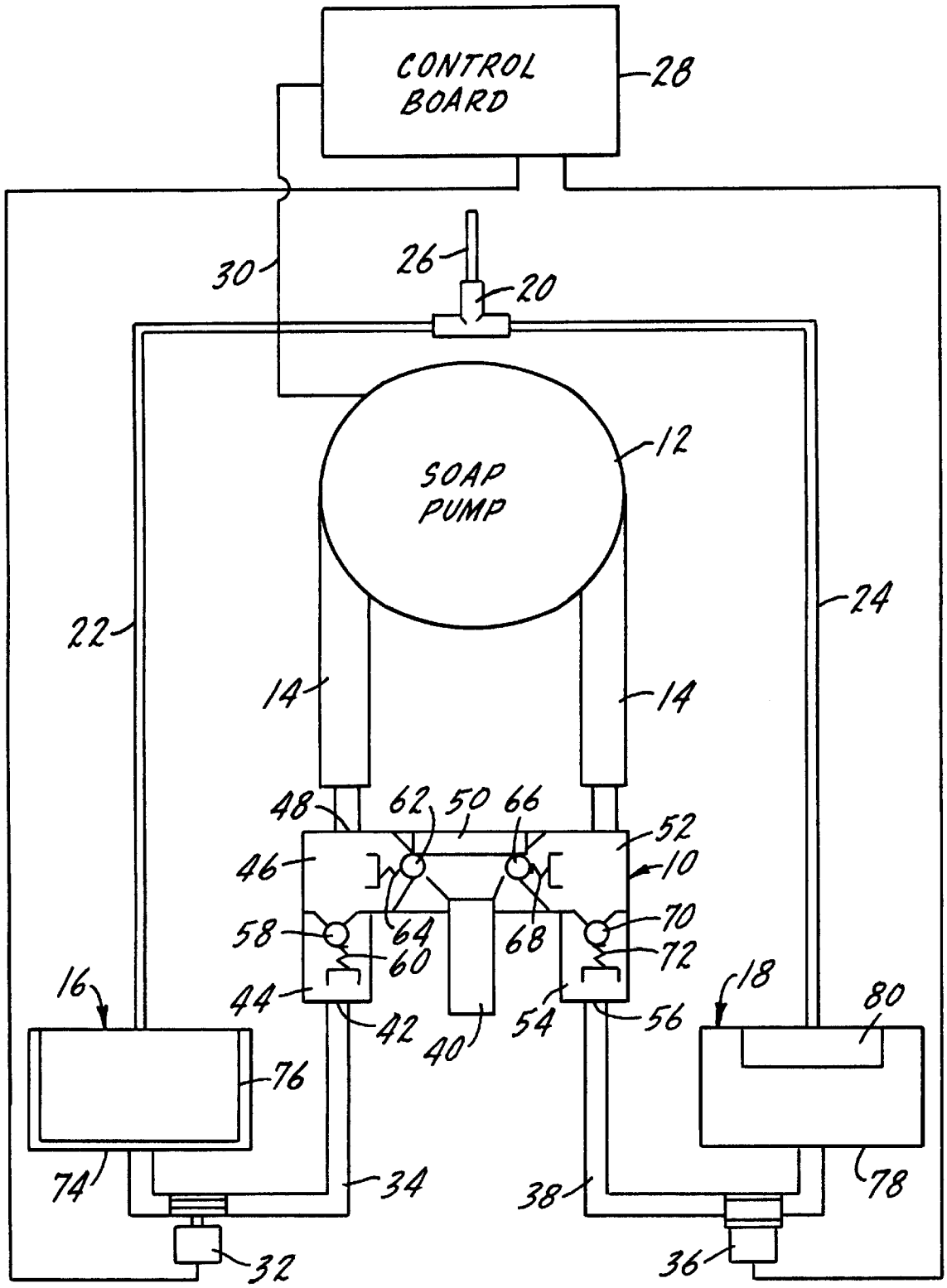
CONTROL BOARD
28
30
26
20
SOAP PUMP
12
22
24
14
14
48
62
50
66
52
46
10
58
64
68
70
60
72
16
44
42
40
54
56
18
80
76
74
34
38
78
32
36

SINGLE SOAP PUMP FOR USE WITH WATER DISPLACEMENT SOAP CONTAINERS AND PERISTALTIC PUMP

This is a continuation-in-part of co-pending applications Ser. No. 09/788,093, filed Feb. 20, 2001, and Ser. No. 09/834,447, filed Apr. 13, 2001.

THE FIELD OF THE INVENTION

The present invention relates to soap dispensers and more specifically to the use of two independent soap containers, and a single peristaltic pump, the rotational direction of which determines which soap container supplies soap to the dispenser. Further, the pump and its associated mechanism is removed from the soap path and uses a separate fluid, for example water, to cause dispensing of soap from one of the two independent soap containers.

U.S. patent application Ser. No. 09/788,093, filed Feb. 20, 2001, shows a soap dispensing system in which there are two unpressurized soap containers and a single peristaltic soap pump. The direction of rotation of the pump determines which container supplies soap. U.S. patent application Ser. No. 09/834,447, filed Apr. 13, 2001, shows a soap dispensing system in which the soap pump is not within the path of soap flow. Rather, the pump applies fluid under pressure to a collapsible soap container, with such fluid pressure forcing soap from the container to a dispensing fixture. The present application combines the concepts of the two above-identified applications in that it uses the two separate soap containers and a single peristaltic pump of the '093 application, however, the soap containers are of the type described in the '447 application.

The advantages of a two-soap container system are several, principally that the soap system as a whole is never empty in that when one container becomes empty, a sensor indicates that fact to a control board which signifies to maintenance personnel to replace the empty soap container, with the system continuing to function with the filled soap container. The advantage of a system in which the pump is not within the soap path is that it avoids the necessity of pumping a highly viscous liquid, such as soap, and it avoids the potential for the pumping mechanism becoming clogged by the soap. Thus, the advantages of two separate concepts are united in this application for an improved soap dispensing system.

SUMMARY OF THE INVENTION

The present invention relates to a soap dispensing system and more specifically to such a system which utilizes two independent soap containers and a single pump which applies the pressure to move soap from the containers to a soap fixture.

A primary purpose of the invention is to provide a soap dispensing system which has automatic soap path selection between two soap containers and a single pump associated with both containers.

Another purpose is to provide a manifold for use in a soap dispenser, which manifold is effective to provide soap container selection on the basis of the direction of rotation of a peristaltic pump.

Another purpose of the invention is to provide a soap dispensing system which includes sensors, and a control board connected to the sensors, with the sensors determining the condition of the soap containers and thus the soap container which will be used upon operation of the pump associated therewith.

Another purpose of the invention is to provide a soap dispensing system in which the pump is isolated from the soap flow path.

Another purpose of the invention is to provide a soap dispensing system in which a fluid, separate from the soap, is used to apply pressure to one of two collapsible sources of soap, with the application of such independent fluid causing dispensing of the soap to a fixture.

Other purposes will appear in the ensuing specification, drawings and claims.

BRIEF DESCRIPTION OF THE DRAWING

The invention is illustrated diagrammatically in the attached drawing which is a diagrammatic illustration of a two-container soap dispensing system.

DESCRIPTION OF THE PREFERRED EMBODIMENT

The present application will describe a soap dispensing system in which there are two separate sources of soap, each having a closed container which receives a source of fluid, for example water, under pressure. Within the closed container there is a flexible container or bag filled with soap, with the bag filled with soap having a connector which allows the soap to be selectably passed to a T-connection which may be part of a soap dispensing fixture. A sensor is associated with each source of soap or more specifically, to the source of fluid pressure which is applied to the closed container. The sensors tell the control board which source of soap should be utilized, which in turn determines the direction of rotation of the peristaltic pump which controls the flow of fluid from a central manifold to one or the other of the soap sources.

The invention should not be limited to the use of a peristaltic pump, although such is highly advantageous. The application of fluid under pressure to one of the two sources of soap could be provided from a source of fluid pressure as controlled by two solenoids, with the operation of the solenoids being responsive to the control board and the two independent sensors. A pump is desirable as it controls the pressure which is actually applied to the sources of soap for constricting the flexible soap containers.

In the drawing, a manifold is indicated at 10 and there is a peristaltic pump 12. A flexible tube 14 extends about the peristaltic pump and is connected to the manifold 10. There is a first source of soap indicated generally at 16 and a second source of soap indicated generally at 18. There is a T-fitting 20 connected by conduits 22 and 24 to the soap sources 16 and 18, respectively, with the T-fitting 20 having an outlet conduit 26 which may be a part of a suitable soap dispensing fixture.

A control board is indicated at 28 and has an electrical connection indicated at 30 to the pump 12. There is a first sensor 32 connected in the fluid conduit 34 which extends from the manifold 10 to the first soap source 16. There is a second sensor 36 connected in the fluid conduit 38 which extends from the manifold 10 to the second soap source 18. The manifold has a fluid inlet or a water inlet 40 which supplies water to be used as a pressurized fluid to effect dispensing of soap from either the first or second sources.

Focusing on the manifold 10, it has the described water inlet 40 and a first water outlet 42 connected to the water conduit 34. A first water chamber is indicated at 44. A second water chamber 46 is connected to a control opening 48 which in turn is connected to one end of the conduit 14.

There is a third water chamber 50 which is connected to the water inlet 40 and a fourth water chamber 52 is connected to the other end of the conduit 14. Finally, there is a fifth water chamber 54 which is connected to the second water outlet 56, which in turn provides water to the conduit 38 connected to the second soap source 18.

A first ball check valve 58 is positioned within the manifold and spring-biased to a closed position by a spring 60 which controls the passage of fluid from the water inlet to the first water outlet 42. A second ball check valve 62, biased by a spring 64 to a closed position, controls the flow of water from the chamber 50 to the chamber 46. Similarly, there is a third ball check valve 66, biased to a closed position by a spring 68, which controls the flow of water between chambers 50 and 52. A fourth ball check valve 70, biased to a closed position by spring 72, controls flow between chambers 52 and 54.

Soap source 16 includes a closed container 74 within which is positioned a flexible container or bag filled with soap and indicated at 76. Water pressure applied to the closed container 74 will tend to collapse the bag 76, forcing soap outwardly from the bag toward the T-connection 20. Similarly, second soap source 18 has a closed container 78 within which is positioned a flexible soap container 80. Again, water pressure applied to the closed container forces soap from the flexible bag 80 toward the T-connection 20 and then to the fixture for the dispensing of soap.

The sensors 32 and 36 are each sensitive to the condition of the conduits 34 and 38 which are indicative of the empty/full condition of the flexible soap bags within the first and second sources of soap. For example, when conduit 34 is semi-collapsed, due to low water pressure within the conduit, the sensor switch is open. This indicates that the soap container 76 is not empty, contains soap, and that the closed container 74 is not full of water. Similarly, if the conduit 38 is fully expanded, the sensor switch will be closed as the soap container 80 is empty of soap and the closed container 78 is filled with water. The indications from the sensor to the control board determine the direction of rotation of the pump so that the pump always functions to apply fluid under pressure to the source of soap containing an adequate supply of soap for dispensing to the fixture.

In operation, and assuming the peristaltic pump is to draw soap from source 16, the pump will rotate in a counterclockwise direction. Rotation in this direction creates a pressure drop in chamber 52. When the pressure drop in this chamber is greater than the force of spring 68, valve 66 will open. When valve 66 opens, a pressure drop is created in chamber 50. The pressure drop in chamber 50 draws water from inlet 40. The water then passes from chamber 50 to chamber 52 via the opened valve 66. The water then passes from chamber 52 to the pump 12 via conduit 14. Now pump 12 forces pressurized water into chamber 46 via conduit 14. When the pressure in chamber 46 increases above the spring force of spring 60, valve 58 will open. When valve 58 opens, pressurized water will flow from chamber 46 through valve 58 and outlet 42. From outlet 42 pressurized water flows through conduit 34 into container 74. This fluid pressure applied to the closed container 74 will cause the flexible bag 76 to in part collapse, forcing soap out of the bag 76 via outlet 16. From outlet 16 the soap will flow through conduit 22. From conduit 22 the soap will flow into the T-fitting 20. The soap now flows from the T-fitting into conduit 26 and out to the desired soap dispenser fixture. When it is desired to dispense soap from the other source, the rotational direction of the pump is the reverse.

The sensors indicate to the control board the condition of the soap containers. Normal operation will focus on one container or source until it is empty and then the control board will cause rotation of the pump in the opposite direction and the other container will be utilized as the soap source. The control board may have suitable indicia or indicators to allow maintenance personnel to know when a container is empty and it must be replaced.

What is important in the invention is that there are alternative soap containers for use and that the soap never enters the pump. The invention provides a means to quickly and easily replace soap containers and all parts that come in contact with the soap. The peristaltic pump is never within the path of soap flow and pressure is applied by the pump, through an independent fluid such as water, to either of the sources of soap. The direction of rotation of the pump determines which soap container is supplying soap and the control board provides the necessary direction to the pump by accepting information from the associated sensors.

Whereas the preferred form of the invention has been shown and described herein, it should be realized that there may be many modifications, substitutions and alterations thereto.

What is claimed is:

1. A soap dispensing system including a soap dispensing fixture, first and second sources of soap connected to said fixture, said first source of soap including a first closed container, a first collapsible soap container positioned within said first closed container, a first fluid inlet for said first closed container, said first collapsible soap container being connected to said soap dispensing fixture, said second source of soap including a second closed container, a second collapsible soap container positioned within said second closed container, a second fluid inlet for said second closed container, said second collapsible soap container being connected to said soap dispensing fixture, a source of fluid pressure, control means for connecting fluid from said source of fluid pressure to either said first fluid inlet or said second fluid inlet, to apply fluid, under pressure, to either said first or second source of soap to cause soap to be dispensed from either said first or second collapsible container.

2. The soap dispensing system of claim 1 wherein said control means includes a two-direction pump, effective to cause fluid under pressure to be applied to either said first or second closed container.

3. The soap dispensing system of claim 2 wherein said control means further includes a fluid manifold connected to said source of fluid pressure and to said two-direction pump.

4. The soap dispensing system of claim 1 further including a powered control board, an electrical connection from said control board to said control means, a first sensor associated with said first source of soap, a second sensor associated with said second source of soap, each of said sensors being connected to said control board and functioning to indicate a soap source empty/full condition.

5. A soap dispensing system including a soap dispensing fixture, first and second sources of soap connected to said fixture, said first source of soap including a first closed container, a first collapsible soap container positioned within said first closed container, a first fluid inlet for said first closed container, said first collapsible soap container being connected to said soap dispensing fixture, said second source of soap including a second closed container, a second collapsible soap container positioned within said second closed container, a second fluid inlet for said second closed container, said second collapsible soap container being connected to said soap dispensing fixture, a fluid manifold having a fluid inlet connected to a source of fluid pressure, a first fluid outlet on said manifold connected to the first fluid inlet of said first closed container, and a second fluid outlet on said manifold connected to the second fluid inlet of said second closed container, valve means within said manifold for connecting fluid from said fluid inlet to either said first fluid outlet or said second fluid outlet, to apply fluid, under pressure, to either said first or second source of soap to cause soap to be dispensed from either said first or second collapsible container.

6. The soap dispensing system of claim 5 further including a two-direction pump associated with said fluid manifold and effective to control fluid flowing from said manifold to either said first fluid outlet or said second fluid outlet.

7. The soap dispensing system of claim 6 further including a powered control board, an electrical connection from said control board to said pump, a first sensor associated with said first source of soap, a second sensor associated with said second source of soap, each of said sensors being connected to said control board and functioning to indicate a soap source empty/full condition.

8. A soap dispensing system including a soap dispensing fixture, first and second sources of soap connected to said fixture, said first source of soap including a first closed container, a first collapsible soap container positioned within said first closed container, a first fluid inlet for said first closed container, said first collapsible soap container being connected to said soap dispensing fixture, said second source of soap including a second closed container, a second collapsible soap container positioned within said second closed container, a second fluid inlet for said second closed container, said second collapsible soap container being connected to said soap dispensing fixture, a fluid manifold having a fluid inlet, a first fluid outlet connected to the first fluid inlet of said first closed container, and a second fluid outlet connected to the second fluid inlet of said second closed container, a two-direction pump, a fluid conduit extending from a first control opening on said manifold to a second control opening on said manifold, said pump being associated with said conduit to move fluid from said first control opening to said second control opening, or to move fluid from said second control opening to said first control opening, valve means within said manifold for connecting fluid from said fluid inlet, through said fluid conduit, to either said first fluid outlet or said second fluid outlet, to apply fluid, under pressure, to either said first or second source of soap to cause soap to be dispensed from either said first or second collapsible container.

9. The soap dispensing system of claim 8 further including a powered control board, an electrical connection from said control board to said pump, a first sensor associated with said first source of soap, a second sensor associated with said second source of soap, each of said sensors being connected to said control board and functioning to indicate a soap source empty/full condition.

10. The soap dispensing system of claim 9 wherein each of said sensors is located in the fluid path between the manifold and the source of soap.

11. The soap dispensing system of claim 9 wherein said valve means includes valve elements, within said manifold, movable between open and closed positions, and associated with said manifold fluid inlet, said manifold first fluid outlet, said manifold second fluid outlet, and said manifold first and second control openings, to control the passage of fluid from said manifold fluid inlet, through said fluid conduit, to either said manifold first or second fluid outlet.

12. The soap dispensing system of claim 8 wherein the application of fluid from said manifold to either said first closed container or said second closed container applies pressure to either said first collapsible soap container or said second collapsible soap container, to cause soap therein to be moved from a collapsible soap container to said soap dispensing fixture.

* * * * *